United States Patent [19]

King

[11] Patent Number: 5,060,849

[45] Date of Patent: Oct. 29, 1991

[54] DISPOSABLE, TWO CONFIGURATION, DUAL PURPOSE BOX

[76] Inventor: Fred King, 10942 E. Daines Dr., Temple City, Calif. 91780

[21] Appl. No.: 572,414

[22] Filed: Aug. 27, 1990

[51] Int. Cl.[5] ..... B65D 5/08

[52] U.S. Cl. ..... 229/101; 119/165; 119/168; 229/103; 229/175; 229/176

[58] Field of Search ..... 229/101, 103, 192, 175, 229/176, 177; 141/337, 331, 343; 119/1, 165, 168

[56] References Cited

U.S. PATENT DOCUMENTS

| | | | |
|---|---|---|---|
| 880,410 | 2/1908 | Singer | 229/176 |
| 2,100,888 | 11/1937 | Vine | 141/337 |
| 2,688,433 | 9/1954 | Hamilton | 229/199 |
| 3,581,975 | 6/1971 | Riccio | 119/165 |
| 3,797,727 | 3/1974 | Downing et al. | 229/199 |
| 4,306,658 | 12/1981 | Montealegre | 229/103 |
| 4,791,883 | 12/1988 | Lohman et al. | 229/146 |
| 4,813,376 | 3/1989 | Kaufman et al. | 119/168 |

FOREIGN PATENT DOCUMENTS

| | | | |
|---|---|---|---|
| 2602744 | 2/1988 | France | 229/101 |

*Primary Examiner*—Stephen Marcus
*Assistant Examiner*—Christopher McDonald

[57] ABSTRACT

A disposable, dual purpose box or carton, made from suitable material such as light weight corugated cardboard, with two configurations unlikely designed and constructed so that the empty box of configuration (1), a closed shipping, handling and storage carton for material can be refolded into a new configuration (2), an open top container or tray with new dimensions and volume suitable for reuse for display or to facilitate the use of the material contained in the box when in configuration (1).

5 Claims, 2 Drawing Sheets

DISPOSABLE, TWO CONFIGURATION, DUAL PURPOSE BOX

BACKGROUND OF THE INVENTION (1) Field of the Invention

This invention relates to boxes or cartons containing materials which need another box or tray of a different size, volume and configuration in its use or to facilitate its use and, after its use, is generally disposed of as waste except in the case where used for display of the contents. In the preferred embodiment this invention relates to boxes or cartons containing materials such as; pet litter, automobile crankcase oil, planter material (flats) for seedlings used in vegitable and flower gardens, and the like, which may or may not be inclosed in inner leak proof package.

(2) Description of the Prior Art

Prior to this invention the only known means of providing pets with a litter box and litter, changing oil in the crankcase of an automobile, planting seeds in a flat (open top tray filled with special soil and fertalizer) and the like, has been to obtain the needed material, obtain a suitable open top box or tray and combine the use of both the tray and material to accomplish the desired result. After use, the material generaly is disposed of and, in most cases, the tray is cleaned for reuse. This method is time consumming and often a messy and unplesant task much the same as changing baby diapers before disposable diapers.

SUMMARY OF THE INVENTION

This invention provides a means of foldably combining various portions of a single blank into either one of two box configurations to facilitate shipment and use of material to be disposed of after use. In the case of non toxic material such as pet litter, planter flat soil, and the like, the material may be disposed of by placing the material along with the disposable box in the trash. In the case of liquid toxic material such as automobile crankcase oil, the used liquid is returned to the original, inner, leak proof container for recycling or proper disposal. The empty tray may be recycled or thrown in the trash. A complete new unit with box containing material is obtained each time the process is repeated.

When used as a disposable pet litter box, the scratch material for the litter box is contained in a plastic bag (likely to split or puncture in handling) inside the more durable shipping and handling box in configuration (1) of this invention. To place in use, the carton in configuration (1) is opened and refolded according to enclosed instructions into configuration (2), the open tray configuration. A plactic sheet included in the package is placed over the tray, a false bottom (also included) is placed on top of the plastic sheet and the two are pressed down into the tray until they rest snugly against the bottom of the tray. The false bottom, cut to be a snug fit inside the tray, not only holds the plastic sheet firmly in place, it also adds rigidity and strength to the open top tray configuration to facilitate handling for disposal without mishap, after use. The plastic bag containing the scratch material is opened and the scratch material poured in the tray. The scratch material contained in the box of configuration (1) will fill the tray approximately ½ full, a suitable depth for a pet litter box. The box size can be varied to fit the size of the pet, and the amount of scratch material that can be contained in the box in configuration (1) will fill the tray (configuration 2) to a maximun of ½ full (the open top tray is approx. twice the volume of the box in configuration 1). Boxes described in this invention that contain liquids such as automobile, private aircraft and farm tractor crankcase oil and other material that must be handled in an intermediate step, such as pouring the new oil into an engine, should be in an inner container suitable to accomplish the intermediate function. The procedure for opening and refolding the box is the same as for pet litter.

Therefore, it is among the primary objects of the present invention to provide a novel throw-away or disposable pet litter as a single unit which comprises both the box and scratch material such as special sand.

A further object of the present invention resides in providing a novel two configuration box or carton that is constructed from a single blank of suitable material so cut and prescored as to facilitate foldably constructing either configuration, a closed shipping type box or carton or an open top tray for display or other use.

Still further object of the present invention is to provide a disposable dual purpose box for use in changing the oil in automobile, aircraft and other internal combustion engine crankcaces, and for use as a planter flat in gardening and the like.

Incidental additions and changes to this invention such as hold down clips for the plastic sheet on the edge of the tray, pouring spout when the tray contains liquids and the like may be added without departing from this invention in its broader aspects.

BRIEF DESCRIPTION OF THE DRAWINGS

The features of the present invention which are believed to be novel are set forth with particularity in the appended claims. The present invention, both as to its design and construction, together with further objects and advantages thereof may best be understood by reference to the following description, taken in connection with the accompanying drawings in which:

DESCRIPTION OF THE PREFERRED EMBODIMENT

The present invention discloses a means of constructing a disposable, dual purpose box or carton, using suitable material, such as light weight corrugated cardboard, with two configurations unlikely designed and constructed so that the empty box of configuration (1), a closed shipping, handling and storage carton for material can be refolded into configuration (2), an open top box or tray with new dimensions and volume suitable for reuse in display or to facilitate the use of the material contained in the box when in configuration (1). Changing from configuration (1) to configuration (2) is easily and quickly done without the use of tools, glue or seailing tape. In configuration (2), the open top container is provided with a unique means of rendering it leak proof for liquids or waist solids such as would be found in pet litter boxes or in automobile engine oil change kits.

In general, the box of either configuration includes a blank having a bottom about which intermediate panels are folded along scored lines followed by selective folding of side panels over the intermediate panels to form the basic box. Flaps on the ends of the side panels fold to provide stiffness and permit the formation of either configuration.

Figure 1:
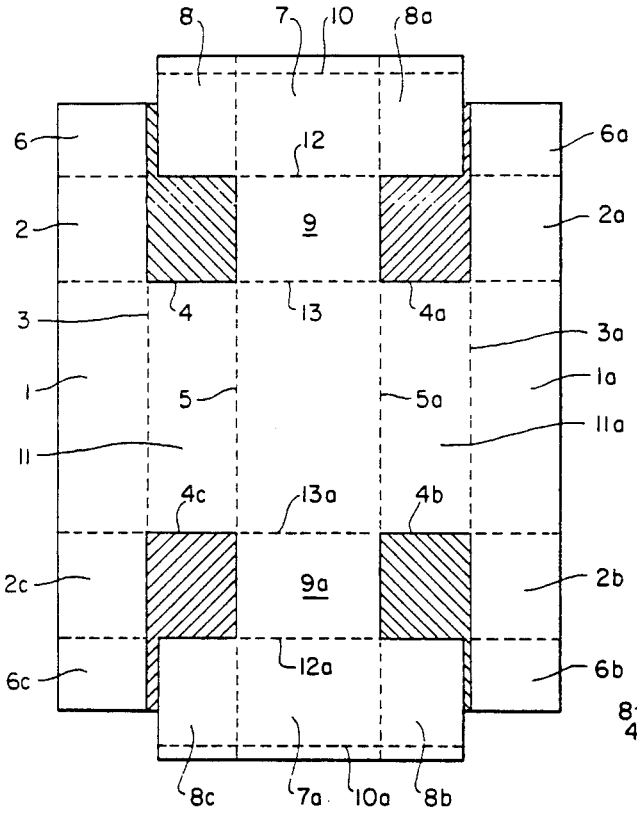
FIG. 1 shows a layout of blank carton or box composed of material such as light corrugated with cut and fold lines necessary to construct almost any desired size of shipping carton shown in FIG. 2 (configuration 1). All cartons so constructed can then be refolded quickly and easily into a sturdy, open top tray with approximately twice the volume (FIG. 6, configuration 2) without the use of tools, glue or sealing tape.

In FIG. 1 and only FIG. 1, broken lines represent scored or fold lines prestressed at the time the blank box material is cut to the desired size for the box to be constructed. Solid lines are cut lines which are either the outer border or around material that is to be removed. Crosshatch sections represent material to be removed.

Figure 2:
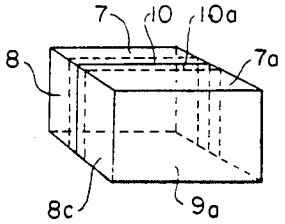
FIG. 2 is a perspective view of the blank for a shipping carton (configuratio 1) made from the material of FIG. 1.
Figure 3A:
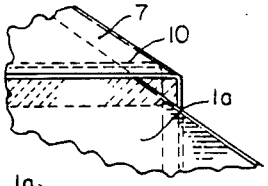
FIGS. 3 and 3A are perspective views showing the carton or box in FIG. 2 partially unfolded.
Figure 3:
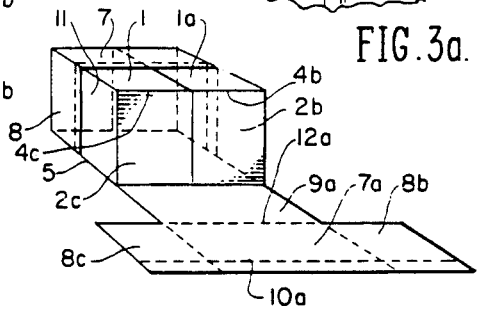
Figure 4:
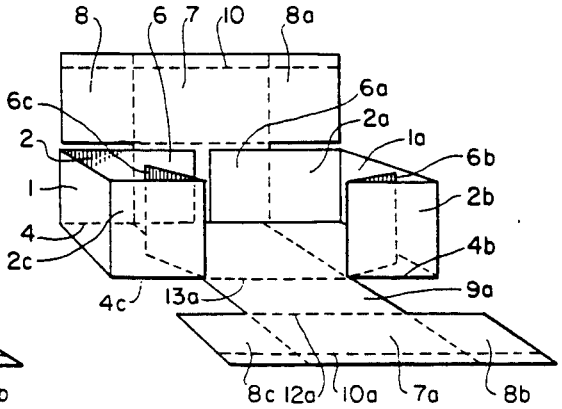
FIG. 4 is a perspective view of the blank with further unfolding of FIG. 3 and with configuration 2 (FIG. 6) starting to take shape.

To construct a box as shown in FIG. 2, start by folding panels 1,2, 2*c*, 6, and 6*c* (FIG. 1) up to the vertical position as seen in FIG. 4. Next, fold panel 2 inward along fold line between panels 1 and 2 until it rests on top of line 4. Seal panel 2 panel 11 with sealing tape along line 4. Repeat the process for panel 2*c* sealing 2*c* to panel 11 along 4*c*. Panels 6 and 6*c* are folded inward along their fold lines and left as loose flaps to be pushed aside by material in configuration 1 (see FIGS. 4,5) since they are only used in configuration 2. Repeat the above process for the opposite side of the box, panels 1*a*, 2*a*, 2*b*, 6*b* and 6*a* (FIG. 4). Next fold panels 11 and 11*a* up along fold lines 5 and 5*a* to form an inner box as shown in FIG. 3 (panels 1, 1*a*, 2*b*, 2*c*). Material to be placed in the box must be placed on the bottom of the box between fold lines 5 and 5*a* before panels 11 and 11*a* are folded up to form an inner box. The box in FIG. 2 is completed by folding panels 9 and 9*a* up along the ends of the inner box then folding panels 7 and 7*a* over the top of the inner box and folding panels 8, 8*a*, 8*b* and 8*c* down along the sides of the inner box. The box is sealed around the center where panels 7 and 7*a* come together. Space between the top of the inner box and the outer shell, where related material such as plastic liner, false bottom, foldup funnel, etc. can be included in the box may be adjusted by raising or lowering the heignt dimension of panel 9, 9*a* without affecting the package so long as the space (see shaded area, blowup view, FIG. 3) does not exceed approx. 50% the height of the inner box (panel 11, 11*a*). Other dimensions that need consideration are panels 7, 8, 8*a* and 7*a*, 8*b*, 8*c*. They should be ½ the length of the box, since they come together at the center. Also, the depth of the box in configuration 2 is limited to ½ the width of the box in configuration 1, since the halves of the inner box come togethet at the center (see FIG. 3).

Figure 5:
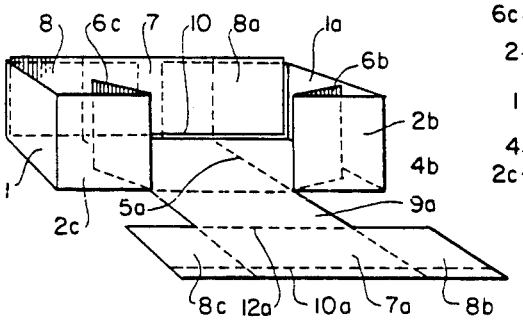
FIG. 5 is a perspective view showing a partial refolding in to configuration 2
Figure 6:
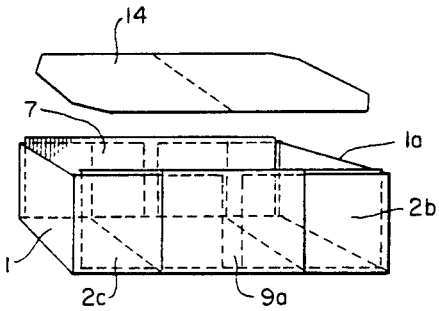
FIG. 6 is a perspective view showing the completed open top tray (configuration 2).
Figure 7:
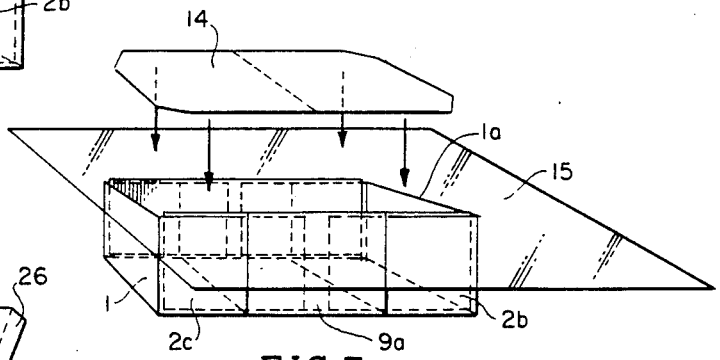
FIG. 7 is the same as FIG. 6 with a transparent sheet of plastic and false bottom shown above the tray. Plastic is used to leak proof the tray.

To convert the box in FIG. 2 (configuration 1) to the open top box in FIG. 6 (configuration 2), the seal at the center between 10, and 10*a* (FIG. 2), is opened and the end panels 7, 8, 8*a*, 9, and 7*a*, 8*b*, 8*c*, 9*a*, are laid back (FIG. 3). The inner box is opened by laying back panels 1, 1*a* and the material in the box is removed (see FIG. 4). Panels 1 and 1*a* become the end panels for the box in FIG. 6 (see FIG's. 3, 4, 5, and 6). Align panels 6, 6*a* with panels 2, 2*a* (FIG. 4), and fold panels 7, 8, 8*a* down over panels 2, 2*a* and 6, 6*a* (FIGS. 4 and 5). Fold line 10 lies along the bottom, inner edge of the box with a portion of panels 7, 8, 8*a* extending into the box along the bottom (FIG. 5). The dimension between fold line 10 and line 12 is equal to the dimention between fold line 12 and line 13. Repeat the steps for the other side of the box, panels 7*a*, 8*b*, 8*c*, and press false bottom (14) down inside the box to lock all panels in place (FIG. 6). A thin sheet of plastic (15), large enough to cover the inside of the box and overlap the outside is installed between the false bottom and the bottom of the box to make the box leak proof (FIG. 7). When a leak proof box is desired the false bottom should be made of a liquid resistant material or should be coated to make the material liquid resistant, such as wax or plastic coated or impregnated corrugated cardboard.

Figure 8:
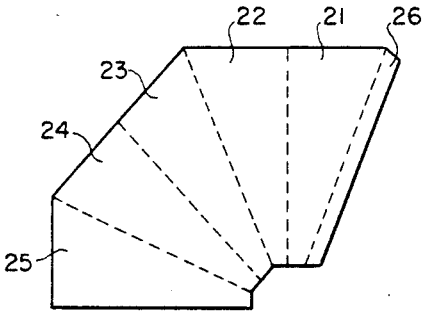
FIG. 8 Shows the layout of a fold-up funnel to be included in the vehicle oil change kit.
Figure 9:
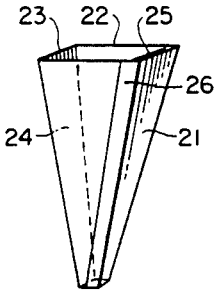
FIG. 9 Shows the funnel in the open mode.
Figure 10:
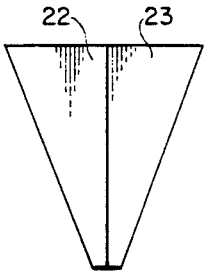
FIG. 10 Shows the funnel in the collapsed mode.

FIGS. 8, 9, and 10 show the layout and construction of a unique collapsible funnel to be included in the package when a liquid such as automobile crank case oil in a special inner container is the material enclosed in the box. The funnel is for the convenience of the customer in returning the used oil to the inner container from the box in FIG. 7 after the new oil has been poured into the automobile engine. The funnel is made of stiff, light weight cardboard (solid, not corrugated) and folded into a square shape pyramid that tapers to a small opening at the bottom as shown in FIG. 9. Pressing on opposite edges of the funnel flattens it into a thin shape as shown in FIG. 10, only twice as thick as the material from which it is made. Pressing on the opposite edges from the ones that collapsed the funnel opens it up into a funnel as shown in FIG. 9.

In the construction, panel 5 is folded inside panel 1 with panel 1 overlapping it. Strip 6 overlaps panel 4 and is glued to it. Panel 5 may be stapled to panel 1 if desired for extra strength. The funnel is disposable as well as the box and liner.

What is claimed is:

1. A disposable multiple configured dual purpose box comprising:

a blank having opposite surfaces of which a selected surface being scored and cut to define side and end fold lines and a plurality of panels;

said panels being folded over upon themselves along said side and end fold lines to define a box-like structure having a bottom surrounded by endwalls and sidewalls;

said panels having end flaps defined by flap fold lines and folded along said flap fold lines to either of a pair of box-like configurations cooperating with adjacent ones of said plurality of panels to provide a continuous peripheral sidewall about a common bottom;

a separate fake bottom having edge marginal regions adapted to be received between said continuous sidewalls to rigidize said box-like configuration; and said false bottom includes a fold line midway between its opposite ends for form-fitting with either of said box-like configurations.

2. The invention as defined in claim 1 wherein:

selected ones of said panels are one-half the length of said box-like configuration.

3. The invention as defined in claim 2 wherein:

selected ones of said panels are one-half the width of said box-like configuration in one configuration of said pair.

4. The invention as defined in claim 1 wherein:

each of said panels being joined to respective sides and ends of said bottom by an intermediate panel having its opposite ends terminate at fold lines joining saud panel with said respective flaps.

5. The invention as defined claim 4 wherein:

said first mentioned blank having four openings defined between opposing flaps and intermediate panels permitting said intermediate panels to be folded normal to said bottom to define one of said pair of box-like configurations.

* * * * *